United States Patent [19]

Adrian et al.

[11] Patent Number: 4,475,472

[45] Date of Patent: Oct. 9, 1984

[54] METHOD AND APPARATUS FOR OPERATING A VORTEX BED FURNACE

[75] Inventors: Fritz Adrian, Ratingen; Boris Dankow, Essen, both of Fed. Rep. of Germany

[73] Assignee: Steag Aktiengesellschaft, Fed. Rep. of Germany

[21] Appl. No.: 402,156

[22] Filed: Jul. 26, 1982

[30] Foreign Application Priority Data

Aug. 1, 1981 [DE] Fed. Rep. of Germany ..... 3130802

[51] Int. Cl.[3] ..... F23D 1/00

[52] U.S. Cl. ..... 110/347; 110/211; 110/214; 110/232; 110/264; 122/4 D

[58] Field of Search ..... 110/347, 263, 264, 245, 110/210, 211, 214, 232; 122/4 D

[56] References Cited

U.S. PATENT DOCUMENTS

| | | | |
|---|---|---|---|
| 519,530 | 5/1894 | Fulton | 110/210 |
| 4,168,670 | 9/1979 | Wall et al. | 110/245 X |
| 4,184,455 | 1/1980 | Talmud et al. | 122/4 D |
| 4,240,364 | 12/1980 | Bryers et al. | 110/347 |
| 4,241,670 | 12/1980 | Blaskowski | 110/263 X |
| 4,259,911 | 4/1981 | Jones | 110/263 X |
| 4,306,854 | 12/1981 | Dawson | 110/245 |
| 4,332,207 | 6/1982 | Blaskowski et al. | 110/347 |
| 4,333,405 | 6/1982 | Michelfelder et al. | 110/347 X |

FOREIGN PATENT DOCUMENTS 1434371 5/1976 United Kingdom .

*Primary Examiner*—Edward G. Favors

*Attorney, Agent, or Firm*—Andrus, Sceales, Starke & Sawall

[57] ABSTRACT

Known vortex bed furnaces have a relatively high structural volume in relation to the firing performance. In addition, special devices are necessary for supplying the vortex bed with fuel and with sulphur-absorbing additives. Without subdividing the bed, a partial load can only be achieved with a vortex bed furnace which differs from the full load by only a small percentage. In order to solve these problems, it is proposed according to the invention that the fuel for the vortex bed should be blown with air via at least one dust burner, unsifted, into the combustion chamber, whereby the fine portion of the fuel conducted in is burnt in the dust flame and the coarse portion drops from the dust flame into the vortex bed. The dust burner serves on the one hand to load the vortex bed and on the other hand to increase the relative firing performance, and can be used to improve the suitability for partial load.

30 Claims, 5 Drawing Figures

METHOD AND APPARATUS FOR OPERATING A VORTEX BED FURNACE

BACKGROUND OF THE INVENTION

This invention relates to a method of operating a vortex or fluidized bed furnace of the kind in which the pulverised fuel, in particular pit coal, is fed into the cooled vortex bed and is burnt there, and in which an agent which absorbs sulphur is placed in the vortex bed.

It is known that fuels which are high in ballast and which contain sulphur and nitrogen can be burnt in a vortex bed at relatively low temperatures (800°–900° C.) to reduce the formation of $NO_x$ and, with the addition of an agent which absorbs sulphur, to reduce the formation of $SO_2$. The known vortex bed furnaces are large in volume with regard to burning performance in comparison with dust burner furnaces. In addition, the devices required for feeding fuel and the sulphur-absorbing additives into the vortex bed are of complicated construction and susceptible to trouble.

In operating the vortex bed, the fine portion of the pulverised fuel is blown out of the vortex bed by the fluidising and combustion air, without the particles being ignited and burnt. Furthermore, in a vortex bed furnace only a partial load of around 75% of the full load can be achieved without subdividing the bed. When the vortex bed is ignited with hot air, the ignition temperature is gained relatively late, whereby a sudden arcing of the bed can occur. Excess temperatures can thereby occur in the combustion chamber and in the devices connected to this chamber, such as, for example, the bag filter for flue gas separation.

In radiant furnaces or coal dust furnaces, smaller structural volumes can be obtained in relation to burning performance, and the partial load can be reduced to 30% of the full load. However, an extensive combustion which is low in $SO_2$ is not possible, especially with pit coal, so that the flue gases containing $SO_2$ produced during combustion are desulphurised after cooling in special flue gas desulphurisation plants. It is therefore attempted to remove at least part of the sulphur from the fuel by mechanical or electrical means by special fuel preparation processes. The problem of the $NO_x$ formation in the dust burners has not yet been satisfactorily solved.

The object of the present invention, therefore, is to produce a method for operating a vortex bed furnace which permits an increase in the relative burning performance and which simplifies the loading of the vortex bed.

SUMMARY OF THE INVENTION

This object is achieved in that the pulverised fuel for the vortex bed is blown with air via at least one dust burner, unsifted, into the combustion chamber, whereby the fine portion of the fuel conducted in is burnt in a dust flame and the coarse portion drops from the dust flame into the vortex bed.

In ballast coal containing mine wastes and pyrite, the mine wastes and pyrite are essentially found in the coarse portion, due to their high specific density and their manner of pulverisation, and are therefore burnt in the vortex bed with the coarse portion of the coal, whilst the fine portion consisting essentially only of coal is burnt in the dust flame. The loading of the vortex bed flame and dust flame takes place simultaneously.

If a coarser grain size of coal is blown in, the spectrum of grain size being essentially above the upper limit of grain size customary for a dust furnace, then there occurs a reduction in temperature of the dust flame (see German Patent Specification No. P.3011631). By using unsifted ground dust, or more precisely by using fine coal which is only crushed or not pretreated, then a greater decrease in temperature of the flame occurs and thereby an effective reduction in the formation of nitric oxide in the dust flame, as this is the case with a sifted dust with an upper limit of grain size.

Preferably the dust flame is composed of a (preferably adjustable) spiral flow of primary air supplying the fuel dust, and a high momentum secondary air flow which is enclosed by the primary air flow. A strong sifting action is exerted on the grains of fuel fed in by the spiralling of the primary air flow, assisted by the force of gravity and the return current of the flue gas more or less present in the combustion chamber, whereby the fine portion is drawn in by the secondary air flow and the heavier coarse particles are discharged from the dust flame and fall into the vortex bed.

In order to simplify the loading of the vortex bed, it is appropriate for the sulphur-absorbing additive to be passed through the dust burner of the vortex bed, together with the fuel dust. Limestone with a grain size of between 6–10 mm is preferable for this purpose. With such a loading and in using coal containing mine waste and pyrite as fuel, the additive, mine waste, pyrite and coarse coal particles are discharged from the dust flame in the vortex bed by means of the sifting action described above. By this means, there is obtained a uniform surface loading of the vortex bed with the vortex bed fuel which is enriched in mine waste and pyrite and uniformly mixed with the flux.

By altering the momentum of the primary air and, above all, of the spiral rotation of the primary air, the sifting action can be varied, and thereby the separating limit of grain size between the grains burnt in the dust flame and the grains discharged into the vortex bed can be adjusted. By this means, the fuel present in a predetermined distribution of grain size can easily be distributed as desired on the coal dust firing process and the vortex bed firing process.

In a dust burning process, around 30% partial load can be achieved as the smallest load, whilst in a vortex bed burning process the smallest load which can be obtained is around 75%. In the method proposed according to the invention, with a given grain size of the fuel to be burnt, the two combustion processes can be controlled between the smallest and greatest load. Thereby the greater the portion of fine grains in the fuel to be burnt, the more favourable is the behaviour of the partial load.

When carrying out the method according to the invention for operating the vortex bed furnace, the behaviour of the partial load can be influenced not only by adjusting the spiral rotation of the primary air, but also by the grain size of the fuel to be burnt.

One method of pulverisation is achieved in a particularly easy way if a fuel which is crushed by impact is fed into the furnace. Impact pulverisation can be achieved with pneumatic impact pulverisers or with other impact crushers such as impact pulverisers, beater mills or pugmills. A variation in the grain size can be achieved by a change in the impact momentum. The impact effect on the coal causes the soft carbon mass which is low in sulphur to explode easily into dust, whilst on the other hand the hard pyrite and mine waste remain largely unpulverised, and as coarse grain have the smallest grain surface. The pulverisers or mills are to be used without graders.

It is advantageous for the fuel to be submitted to a single impact pulverisation. Appropriately, the fuel, particularly fine coal or else crude rough coal with a maximum grain size of 30 mm, is accelerated by a controllable impact air flow to an impact speed corresponding to the desired grade of pulverisation and is then driven on to a hard impact surface.

By an optimum control of the force of the impact pulverisation, with a minimum of pulverising energy and wear on the impact surface, a pulverisation of the fuel is achieved into a largely sulphur-free fine dust for the dust flame process and a vortex bed fuel which is rich in sulphur and mine waste with a small free grain surface. Owing to the small grain surface, the sulphur portions of the coarse portion are not burnt in suspension, but are first burnt in the vortex bed in the presence of the flux absorbing the sulphur dioxide.

A control of the grade of pulverisation is achieved by controlling the impact momentum. A variation in the impact momentum with a pneumatic pulveriser can be achieved by varying the distance between the outlet point of the impact flow into the free space and the impact surface, and/or by varying the speed of the impact flow as it leaves the nozzle. A change in momentum of the impact air flow can take place independently from the primary air conducted to the burner. With a full load, the amount of primary air to be conducted to the burner is used as the impact flow, so that the amount of fuel is very finely pulverised by impact. Thereby the spiralling effect in the dust flame is decreased or even reduced to nothing. With a partial load, the impact air flow is decreased and on increasing the primary air the spiralling effect is increased. If the furnace is designed in such a way that with a full load the two combustion processes have equal load proportions, then with the integrated boiler furnace of vortex bed and dust burner, the smallest load comes to around 50%, whereby the load proportion of the vortex bed is around 35% (75% $\times$ 0.5) and the load proportion of the dust furnace around 15% (30% $\times$ 0.5). By alteration of the pulverisation procedure, by the discharge of fuel controlled by sprial flow into the furnace and by the distribution of the combustion air in the vortex bed and dust burner, the most diverse load conditions can be controlled to the maximum.

In mills without graders, the grade of pulverisation can be controlled by speed regulation.

A further decrease in the smallest load can be temporarily achieved by turning off the dust burner flame. Furthermore, it is possible to operate several combinations of vortex bed and dust flame next to one another in one combustion chamber, which can be switched on and off individually according to the minimum load required.

Ignition of the vortex bed does not have to be carried out by a separate heating device, for example an electrical heating device, since the vortex bed is appropriately ignited by the radiant heat of the dust flame. After its oil, gas or electrical ignition, the dust flame is first of all operated with excess air and in particular with fine dust, that is, at an increased temperature, until the vortex bed is heated by the radiant heat of the dust flame to the required temperature, and ignites when the combustion air is brought into the vortex bed. Thereafter, the method of driving the furnace can be altered according to the requirements of the desired load conditions.

In using an impact pulverised fuel, it is of advantage if, when impact pulverising the fuel, the fine portion is gathered together and used as ignition dust for the dust flame or as regulating dust for varying loads. The coarse grains of fuel resulting from the impact pulverisation can be intermediately stored in a bunker.

Particularly when using fuels with a very high water content, such as ballast coal, waste, slurry, it is appropriate to dry the fuel before and/or during the impact pulverisation. A return suction of fuel gas from the combustion chamber is available as the heat source for this purpose.

In order to be certain of preventing a residue of $NO_x$ formation, the dust flame is operated under-stoichiometrically and the vortex bed furnace operated with excess air. The dust flame is only supplied with enough combustion air to guarantee stability of the flame by an extensive combustion of the finest portion of grain. By this means the dust flame is limited as a result of a lack of air, that is, the combustion process is stopped prematurely, whereby the carbon dioxide formed in the presence of the unburnt but highly tempered coal dust in an endothermic process is reduced to carbon monoxide, and therewith the flame is additionally cooled by the effect of the coarser temperature-reducing dust. In connection with this reduction zone, the unburnt combustion products are afterburnt near-stoichiometrically by blowing in air or a mixture of air and flue gas. By the measures described above, the flame is intensively cooled so that formation of nitrogen is not possible.

To reduce the remaining sulphur dioxide content, a small amount of a sulphur oxide absorbing agent such as, for example, a CaO, MgO, $MgCO_3$ or $CaCO_3$ powder or a mixture of these compounds can be blown into the flue gas which has already been extensively cooled, before dust removal. Hereby, the content of chlorine and fluorine in the flue gas is also reduced. The powdered products which are produced are separated off together with the flue dust.

The combustion can be carried out totally near-stoichiometrically, whereby the optimisation of the whole combustion process is achieved by distribution and displacement of the amount of combustion air between the dust flame and vortex bed furnace and the afterburning zone.

It is also possible, with sufficient excess air, to achieve an afterburning of the flue gases emitted from the vortex bed in connection with the reduction zone and the cooling zone, solely by turbulence of the flue gases to be fed to the vortex bed and dust flame.

The invention includes within its scope a furnace with a fuel supply device, a combustion chamber, at least one vortex bed attached to this chamber, a fluidising air and combustion air supply device for the vortex bed, a cooling device for the vortex bed and a feeding device for conducting an additive which absorbs sulphur into the vortex bed, wherein at least one dust burner connected with the fuel supply device is attached to the combustion chamber in such a way that the portions of fuel dust not burnt by the dust flame can drop onto the surface of the vortex bed.

Preferably the dust burner is arranged in the vortex bed as a bottom burner and it opens upwardly, so that the outlet directions of the primary air flow and secondary air flow are opposed to the force of gravity.

It is also possible, however, for the dust burner to be arranged above the vortex bed as a ceiling, corner or side burner. The various arrangements of dust burner can also be combined. The burner is preferably in the form of an annular burner with a primary air tube including a spiralling device and with a central secondary air tube.

It is appropriate for an afterburning chamber to be connected to the burning area of the flame in the combustion chamber, to which afterburning air can be supplied. Pure air or a mixture of flue gas and air is meant here by afterburning air.

Preferably a fuel preparation device without a grader is connected to the fuel supply device, this fuel preparation device making use of the effect of impact for pulverising the fuel, such as, for example, a pneumatic impact pulveriser or a beater mill without grader. To achieve a better partial load operation, it is advantageous for the impact flow in the case of the pneumatic impact pulveriser or the rotational speed of the impact beater mill to be controllable.

Especailly preferable is a furnace wherein a baffle plate is arranged in a container, to which plate an impact nozzle of an impact circuit supplying fuel-air is fitted, and wherein the lower end of the container is connected with a primary air tube leading to the dust burner, and the upper end of the container is connected via an exhaust air tube with the primary air tube, upstream of the fuel feed point, and the impact circuit and primary air tube can be controlled by air.

In order to ignite the dust burner and the vortex bed, it is of advantage if the fuel preparation device has a filter for separating off the finest dust as ignition dust.

In order to increase the overall efficiency and to improve the partial load behaviour, it is possible for the furnace to be composed of several disengageable vortex bed/dust burner units. By this means the dust burners are attached to the centres of the vortex beds. The vortex bed sections can have various forms, for example, square, triangular, hexagonal, or a circular sector. From these basic elements, square, rectangular or differently shaped cross-sections of the combustion chamber can be formed. In the units, several dust burners can also be attached to the vortex bed sections. They are to be arranged in such a way that the vortex bed sections are coated with fuel as uniformly as possible.

DETAILED DESCRIPTION OF THE PREFERRED EMBODIMENTS

Figure 1:
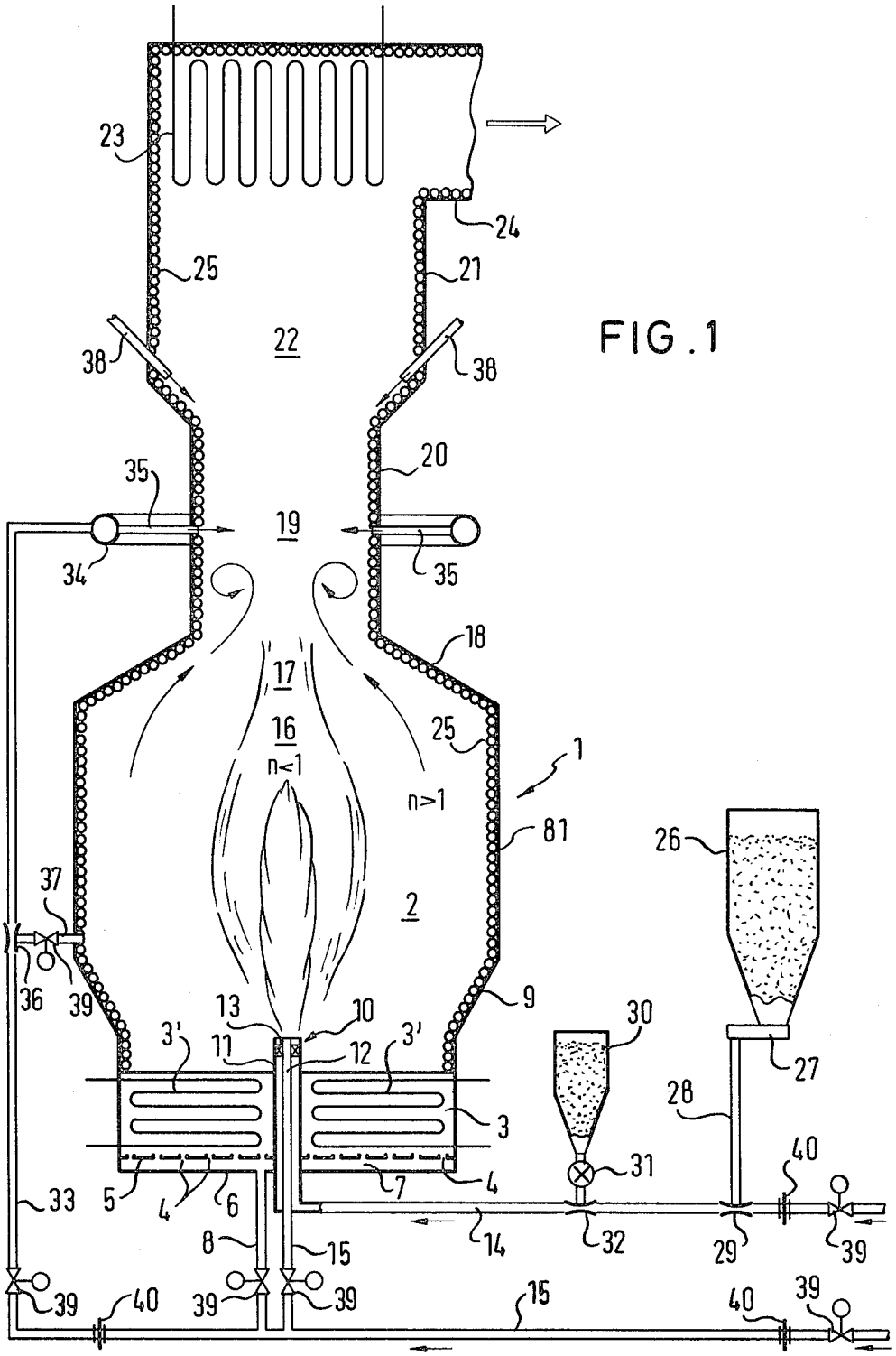
FIG. 1 shows a boiler furnace consisting of aa vortex bed and a dust burner arranged in the vortex bed.

In the boiler furnace 1 shown in FIG. 1, a vortex bed 3 is arranged on the lower end of a combustion chamber 2. Between a base 5 provided with fluidising nozzles 4 and the base 6 of the combustion chamber, a distribution cavity 7 is formed, which serves as the air distributor, the fluidising and combustion air being supplied to this distribution cavity via an air tube 8, referred to as a fluidising air tube. Cooling coils 3' are arranged in the space in the vortex bed occupied by the vortex bed fuel in a fluidised state, these cooling coils being charged with a cooling agent by a method which is known and therefore not shown, in such a way that the temperature in the vortex bed preferably reaches 800° to 900° C. A stabilising zone 9 which serves to decrease the speed of flow of the air emerging from the vortex bed, and which is therefore of increased cross-section, is connected to the vortex bed 3.

A dust burner 10 in the form of an annular burner is arranged in the centre of the vortex bed 3, this burner consisting of a primary air tube 11 and a secondary air tube 12 arranged concentrically within this. The outlet ends of the air tubes 11 and 12 lie above the contract surface of the fluidised fuel of the vortex bed 3; a spiralling device 13 is arranged in the region of the annular outlet opening of the primary air tube.

The primary air tube 11 is connected with a primary air pipe 14 and the secondary air tube 12 with a secondary air pipe 15. The fluidised air pipe 8 is also connected with the secondary air pipe 15.

The burning area 81 of the dust flame is connected to the stabilisation zone 9 of the combustion chamber, a reduction zone 16 and a cooling zone 17 being formed in the upper section of this burning area, whereby the combustion narrows in these areas in a narrowing section 18. A neck 20 defining an afterburning zone 19 is connected to this narrowing section. The neck 20 is followed by an extension 21 defining a reaction zone 22, ancillary heating surfaces 23 being arranged at the end of the extension and the flue gases from a dust removal device, which is not shown, being fed from the extension through a flue gas pipe 24. The combustion chamber is provided with piping 25 on its inner surfaces which are not in contact with the vortex bed.

The dry, unpretreated fine coal is fed from a fine coal bunker 26 through a feeder 27, a down pipe 28 and a coal delivery nozzle 29 of the primary air pipe 14.

Between the coal delivery nozzle 29 and the connection of the primary air pipe 14 with the dust burner 10, a limestone bunker 30 is connected with the primary air pipe via a feeder 31 and a limestone delivery nozzle 32. Limestone which is coarsely broken and classified in a grain size of preferably 6 to 10 mm is contained in the limestone bunker. The primary air pipe 14 and the secondary air pipe 15 are loaded with air, as is shown by the arrows in FIG. 1. Separate sources of compressed air or one and the same source of compressed air can be used for this purpose.

The secondary air pipe 15 is connected with a ring conduit 34 via an afterburning air pipe 33. The ring conduit 34 is connected with the afterburning zone 19 in the recess 20 by means of afterburning air nozzles 35.

Furthermore, in the afterburning air pipe 33 a flue gas supply nozzle 36 is provided, which can extract flue gas from the combustion chamber through a flue gas pipe 37 which is connected to the combustion chamber 2, so that air or a mixture of air and flue gas can be supplied to the afterburning zone 19 via the ring conduit 34.

Nozzles 38 are provided in the reaction zone, through which dust which absorbs sulphur dioxide, fluorine and/or chlorine, from a source which is not shown, can be blown, such as CaO, MgO, $MgCO_3$, $CaCO_3$ or mixtures of these.

Valves 39 are arranged in the pipes 15, 8, 33 and 37.

In operating the furnace, the secondary air emerges from the secondary air tube 12 into the combustion chamber 2 as a free jet which is high in momentum and controllable by the valve 39, this free jet flowing vertically upwards. A mixture of coal-limestone-air emerges from the primary air tube 11, and an axial rotation is imposed on this mixture by the spiralling device 13. By adjusting the spiralling device and/or varying the air speed, the axial rotation can be controlled. The heavy coarse limestone particles, mine waste and pyrite particles and heavy particles of coal with a high speed of descent are brought into the vortex bed 3 under the influence of the force of gravity and the return current of the burner flame. The fluidising air pipe 8 is loaded by means of the valve 39 arranged in it in such a way that an adequate fluidisation and a combustion under excess air takes place. By this means there results an absorption of the sulphur from the line which is introduced. As a result of the low temperature of 800° to 900° C., preferably 850° to 900° C., the combustion takes place largely without any $NO_x$ formation.

The fine portion in the primary air flow carried into the combustion chamber 2 and stripped of its sulphur content is drawn in by the secondary air flow and, as a result of its low speed of descent, is carried upwards in the combustion chamber 2 and partly burnt. The finest portion of dust thereby guarantees the stability of the flame. Since the dust furnace is operated essentially under-stoichiometrically ($n<1$), only an incomplete combustion results. Therefore the reduction zone 16, in which the combustion products are additionally cooled by the endothermic reduction processes, is connected to the dust flame which has only a limited axial expansion. Additionally, the flue gases are further cooled in the cooling zone 17 lying in the narrowing section 18 and connected to the reduction zone 16, by the combustion chamber heating surfaces 25 fitted there.

In the narrowing section 18, the cross-section of the combustion chamber 2, around half of the original cross-section in which the dust flame burns, leads into the afterburning zone 19. The unburnt flue gases from the reduction zone 16 ($n<1$) and the flue gases ($n>1$) which are rich in air, coming from the vortex bed and flowing in the region of the combustion chamber wall, flow into this afterburning zone and are submitted to turbulence there. If the content of air in the vortex bed flue gases is not sufficient to achieve complete afterburning of the unburnt products in the after-burning zone 19, additional amounts of air are blown into the afterburning zone by means of the afterburning air nozzles 35. A further cooling of the flue gases takes place in the afterburning zone via the piping 25, for example to around 1,000° C.

A flue gas which is largely free from nitric oxide and sulphur dioxide emerges from the afterburning zone 19. In order to further reduce the remaining sulphur content and the content of fluorine and chlorine, limestone dust, for example, can be blown through the nozzles 38 at the start of the reaction zone 22. This limestone dust is reduced to calcium oxide at the prevailing temperatures, and can then combine with the harmful substances to form solid compounds. Flue gas with a temperature of 100° to 130° C. and an n. of 1.1 to 1.3 is fed through the flue gas pipe 24 to a dust removal device which is not shown.

When putting the vortex bed and dust burner integrated furnace into operation, first of all the dust burner 10 is operated with fine dust supplied via the primary air pipe 14 with the minimum axial rotation adjustment of the spiralling device 13 and excess air. The fuel in the vortex bed is uniformly preheated by the radiant heat and is gradually brought to its ignition temperature. The ignition process is easily controlled by selecting the parameters: air supply to the dust flame, air supply to the vortex bed and adjustment of the spiralling device. In FIG. 1, flowmeter devices 40 are placed in some of the pipes next to the regulating devices or valves 39.

Figure 2:
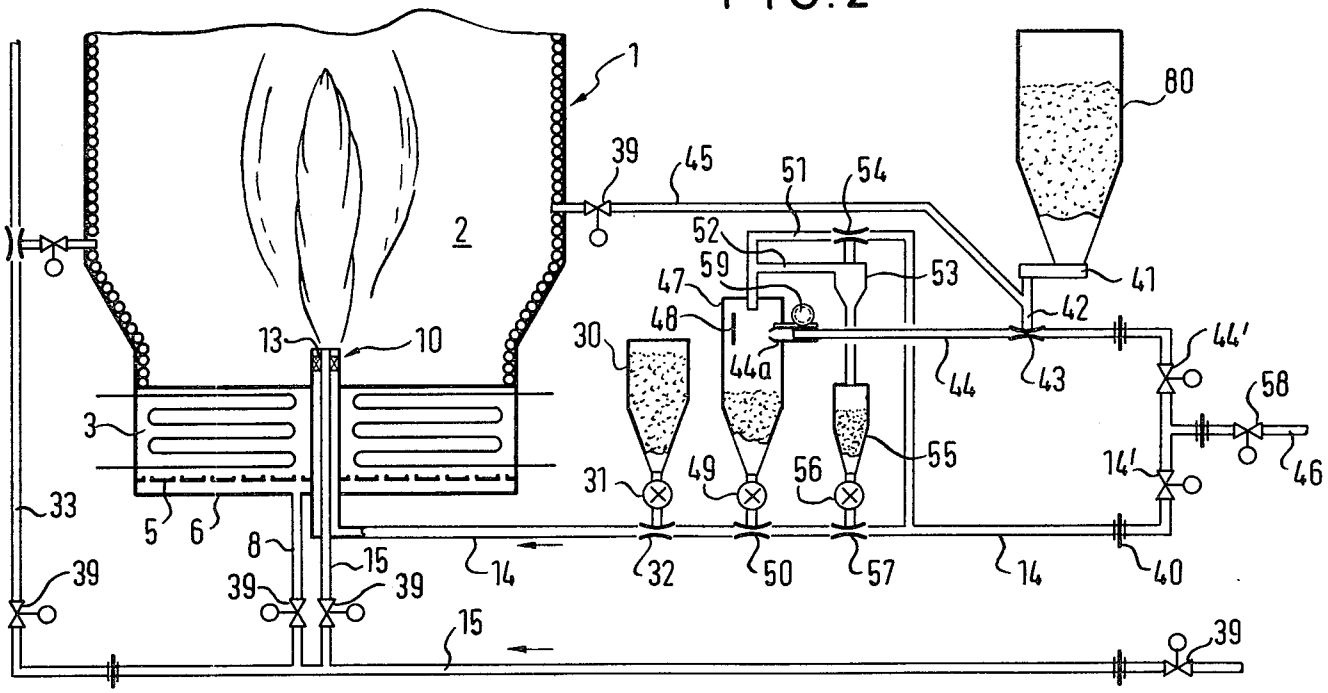
FIG. 2 shows a partial diagram of the boiler furnace according to FIG. 1, with a fuel pulverisation device which is particularly suitable for the furnace.

In the embodiment of the boiler furnace according to the invention shown in FIG. 2, crude rough coal is used instead of fine coal. The crude rough coal is sieved by means of a sieve device, which is not shown, to a maximum grain size, preferably 30 mm. The remaining oversized grains are coarsely broken in a crusher which is not shown, so that raw coal with a predetermined maximum grain size is present in the bunker 80. Coal is delivered into an impact air pipe 44 through a feeder 41, a downpipe 42 and a coal supply nozzle 43. The downpipe 42 is connected to the combustion chamber 2 by a hot gas return-flow pipe 45. As a result of the jet pump effect of the coal supply nozzle 43, hot gas is drawn in from the combustion chamber 2. The impact air pipe 44 is connected to a supply air pipe 46 by a valve 44'. The primary air pipe 14 is connected to the supply air pipe 46 by a valve 14'.

The orifice **44*a* of the impact air pipe is aligned to an impact plate 48 inside a container 47. The lower end of the container 47 is connected to the primary air pipe by a feeder 49 and a coal supply nozzle 50. The upper end of the container 47 is connected to the primary air pipe 14 upstream of the coal supply nozzle 50 by means of an impact air pipe 51**.

A pipe 52 branches off from the impact air pipe 51, this pipe connecting the impact air pipe with a filter 53. The exhaust air from the filter 53 is fed via a jet pump 54 into the impact air pipe 51, whilst the fine dust separated off in the filter is collected in an ignition dust bunker 55, which can also be connected to the primary air pipe 14 by a feeder 56 and a coal dust supply nozzle 57.

Another valve 58 is connected to the two valves 44' and 14' in the supply air pipe 46.

The relative distance of the nozzle orifice **44*a* from the impact plate 48 can be varied. For example, it is possible to move the orifice 44*a* telescopically in and out by means of a pinion drive 59, or to move the impact plate 48. In the latter case, a separate formation of the orifice 44*a*** is not necessary.

It is firstly assumed that the ignition dust bunker 55 is filled with ignition dust by a previous operation of the furnace. In order to ignite the furnace, the primary air pipe is loaded with air via the valves 58 and 14', and ignition dust is blown through the feeder 56 into the primary air tube 11 and is ignited in a known manner by a gas, oil or electrical igniter. After the formation of a stable burner flame and the ignition of the vortex bed by the radiant heat from the burner flame, coal from the container 47 and limestone from the limestone bunker 30 are delivered into the primary air pipe 14.

If the furnace is to be operated with a small load, the valves 14', 44' and 58 are adjusted in such a way that, on the one hand, the flow in the impact air pipe 44 first of all delivers just the coal discharged from the coal bunker 80 into the container 47, whereby only a relatively slight fuel pulverisation occurs, and, on the other hand, a maximum air flow is conducted through the valve 14' into the primary air pipe 14. With a small load, the spiralling device 13 is adjusted in such a way that a maximum spiralling effect takes place, that is, the largest proportion of the relatively slightly pulverised fuel is brought into the vortex bed.

On increasing the boiler load, the speed of flow in the impact pipe 44 is increased. On increasing the impact speed, the hard grains of pyrite and mine waste remain largely uncrushed, whilst, in pulverising the coal, the fine portion increases. With a full load, the valve 44' is fully opened and the valve 14' is closed, so that the total air flow from the supply air pipe 46—enriched with the hot gas sucked back through the pipe 45—throws the coal delivered from the bunker 40 against the impact plate 48. The air flowing through the impact air pipe 44 enters the primary air pipe 14 via the impact air pipe 51 as the maximum amount of primary air, and supplies the maximum amount of fuel taken from the container 47 to the burner. The fuel has the finest degree of pulverisation possible by the impact effect. With a full load, the spiralling effect of the spiralling device is decreased in comparison to a partial load, or even reduced to zero, so that, on the one hand, the proportion of fuel for the dust burner reaches its maximum and, on the other hand, the vortex bed is operated with the portion of coarse grain at full load. With a full load, the proportional load of the dust burner lies at 50% or above. By operating the valves 58, 44' and 14', the loading of the primary air pipe 14 and the impact air pipe 44 can be controlled for the various loading conditions, according to the requirements for the optimum control of the furnace and fuel transport and pulverisation.

A partial flow if split off through a branch pipe 52 from the impact exhaust air flow emerging from the container, and the fine dust contained in the impact exhaust air flow is collected as ignition dust in the ignition dust bunker 55. If, when operating with a full load, the ignition dust bunker 55 is completely filled up, then ignition dust can be delivered into the primary air pipe 14 via the feeder 56. It is also possible to provide a corresponding valve in the branch pipe 52.

Figure 3:
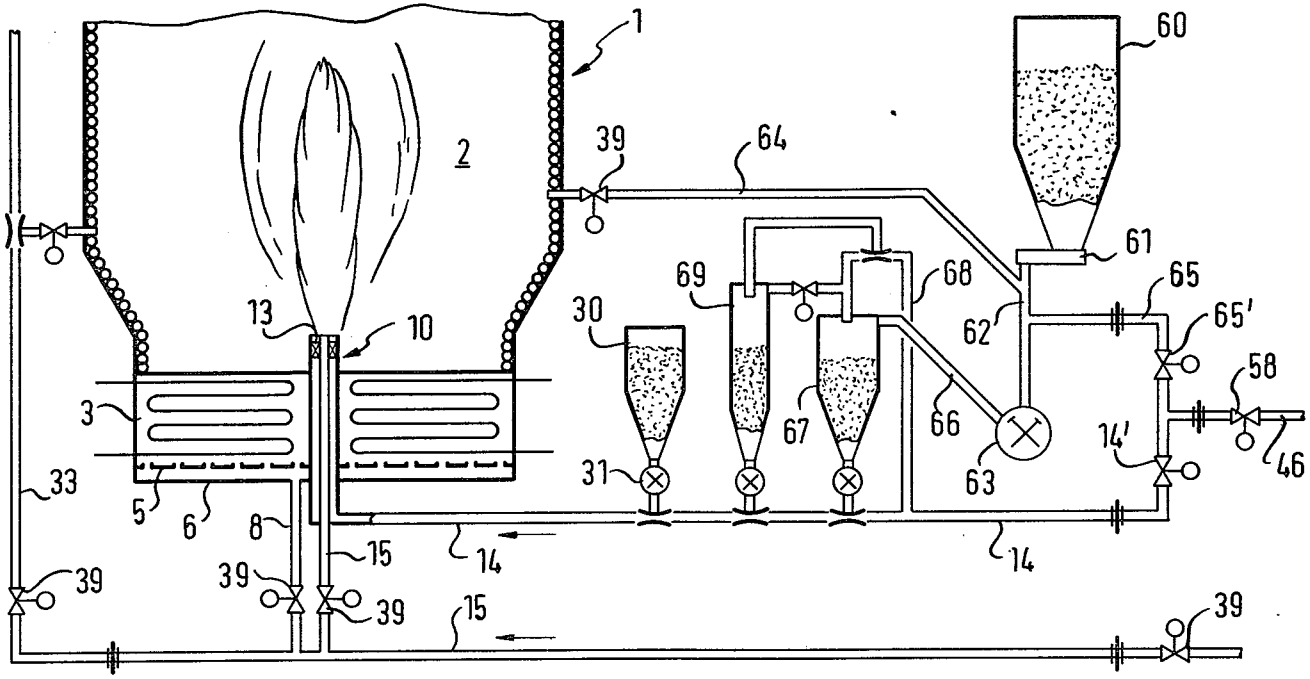
FIG. 3 shows a partial diagram of the boiler furnace according to FIG. 1, with another fuel pulverisation device which is particularly suitable for the furnace.

The embodiment according to FIG. 3 is particularly suitable for fuels with a high water content, with which a pneumatic impact pulverisation, as in the embodiment according to FIG. 2, would not result in the necessary pulverising effect. A coal bunker 60 is connected to a self-priming beater mill 63 without grader via a feeder 61 and a down-pipe 62. The down-pipe 62 is connected on the one hand with a hot gas return-flow pipe 64 and, on the other hand, with a delivery air pipe 65 controlled by a valve 65'. In order to improve the partial load behaviour of the furnace consisting of a vortex bed 3 and dust burner 10, the beater mill 63 is fitted with a motor with variable rotational speed.

The material to be crushed is delivered from the mill 63 through a pipe 66 into a coal bunker 67, which is connected to the exhaust air pipe 14 in the same manner as the container 47. The exhaust air from the coal bunker 67 is fed into the pipe 14 via an exhaust air pipe 68, as in the embodiment according to FIG. 2. For preparation of the ignition dust, an ignition dust bunker 69 fitted as a filter is provided, which is loaded with a partial flow of exhaust air containing the finest coal dust. By suitable control of the valves 14', 65' and 58, and a choice of rotational speed of the beater mill on the one hand and adjustment of the spiralling device 13 on the other hand, various load conditions can be achieved. The furnace according to FIG. 3 also permits a minimum load of up to 50%.

Figure 4:
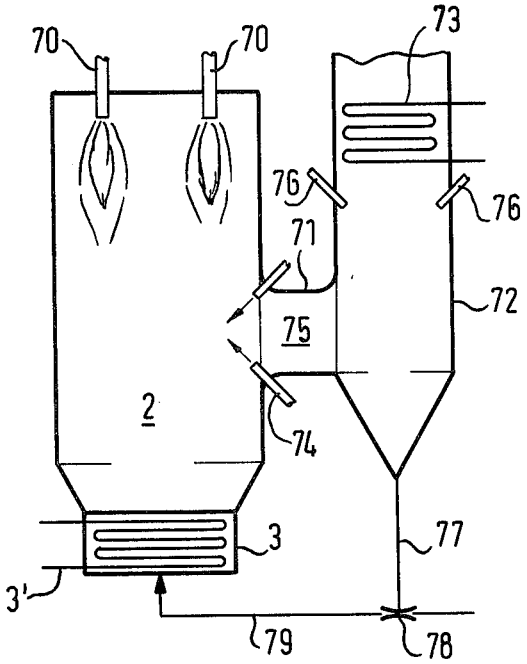
FIG. 4 shows a basic diagram of another embodiment of the boiler furnace with ceiling burners arranged above the vortex bed.

Whilst, in the embodiment according to FIGS. 1 to 3, the dust burner is arranged in the vortex bed, in the embodiment according to FIG. 4 it is proposed that a ceiling burner 70 should be attached to the vortex bed 3, since in this way also simultaneous operation of a dust flame and delivery of fuel to the vortex bed is possible. In this arrangement, the combustion chamber 2 is connected to a gas flue 72 by a discharge pipe 71 which is attached laterally, ancillary heating surfaces 73 being arranged in this gas flue. Just as the afterburning air nozzles 35 are attached to the recess 20 in the embodiments according to FIGS. 1 to 3, so are corresponding afterburning air nozzles 74 attached to the narrowed section 71 in the embodiment according to FIG. 4, afterburning air in the form of pure air or a mixture of flue gas and air being fed through these nozzles into the afterburning zone 75 defined by the narrowed section 71. An addition of dust which absorbs sulphur dioxide, fluorine and/or chlorine takes place here through nozzles 76 in the gas flue 72, opposed to the flue gas flow. The nozzles 76 can also be arranged in the boiler cover. The dust which is produced, in particular $CaCO_3$, can be collected in the funnel-shaped base of the gas flue 72, and can be fed through a pipe 77 and a dust supply nozzle 78 loaded by a delivery air source which is not shown and a pipe 79, into the vortex bed 3.

It would also be possible to use a side or corner burner instead of a bottom or ceiling burner. Combinations are also possible.

Figure 5:
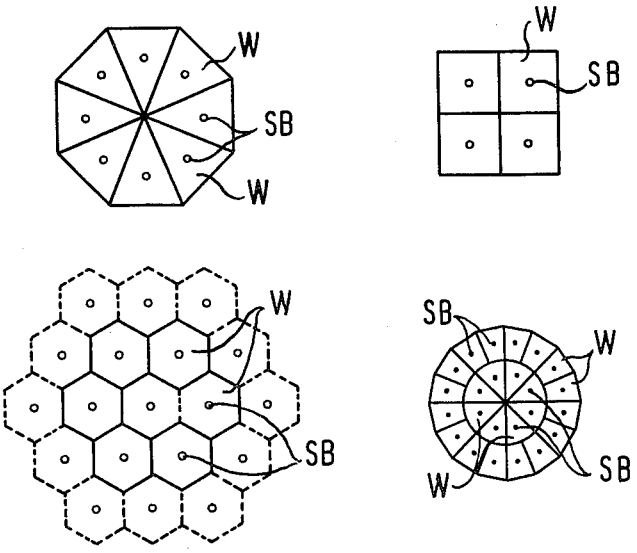
FIG. 5 shows basic diagrams of various furnaces with vortex bed/dust burner units.

Furthermore, it is fundamentally possible to attach more than one dust burner to a vortex bed. In particular, it is also possible—as is shown diagrammatically in FIG. 5 for various geometries by way of example—to combine several units consisting of a vortex bed and at least one burner in one common combustion chamber, in order to obtain a furnace with increased overall efficiency and/or improved behaviour with partial load. In FIG. 5 the dust burners are given the reference SB and the individual vortex beds the reference W.

By the word "valves" used in the application, any devices for controlling the rate of air flow are meant. There are connected with each other by a control and regulating device in such a way that an optimum adjustment of the integrated furnace is possible for any load condition and for any fuel.

From the foregoing, it follows that, in a combination of one or more dust or jet burners with a vortex bed furnace, the fuel must necessarily supply sufficient fine grains to allow the jet burner or burners to burn reliably on the one hand, and on the other hand, in spite of a certain furnace-loss in the suspension, that is in the dust flame, must supply the vortex bed with an adequate amount of coarse-grained fuel. In using coal as the fuel, a pulverisation process should be used for the coal which permits the impurities of the coal which cannot be burnt and which are in the form of mine waste and pyrite—but above all pyrite—to be delivered into the vortex bed in a condition being as uncrushed as possible. For these reasons, such methods of pulverisation were described as being preferable in connection with FIGS. 2 and 3, in which particularly impact energy is used for pulverising the fuel. By means of the possibilities of adjustment which have been specified: varying the flow of impact gas in the case of a pneumatic pulverisation and the rotational speed in the case of mechanical pulverisation (impact pulveriser, beater mill, pugmill), the firing performance of the furnace can be varied, whilst the efficiency of the fast-reacting dust flame is altered by varying the fine proportion of the fuel fed to the furnace via the jet burner. If, in the method described, fine dust is drawn off during pulverisation and is supplied as ignition dust, this fine dust can still improve the adjustability of the overall performance by means of controlled addition to the dust fed to the burner.

We claim:

1. A method of operating a fluidized bed furnace with pulverized fuel, in particular, pit coal having, as a result of its pulverization, a fine particle portion and a coarse particle portion, said method comprising the steps of:
   establishing a fluidized bed;
   blowing a primary air flow supplying the pulverized fuel above the fluidized bed;
   separating the fine particle portion of the pulverized fuel from the coarse particle portion above the fluidized bed;
   blowing a secondary air flow concentric to said primary air flow;
   burning the fine particle portion of the pulverized fuel above the fluidized bed in a flame defined by the two air flows; and
   allowing the coarse particle portion to fall into the fluidized bed for combustion.

2. A method according to claim 1 wherein the step of supplying the pulverized fuel is further defined as blowing an axially rotating primary air flow supplying the pulverized fuel and providing, to said primary air flow, the concentric secondary air flow with high momentum.

3. A method according to claim 2 wherein the step of supplying the pulverized fuel is further defined as providing a secondary air flow enclosed by the primary air flow.

4. A method according to claim 2 further defined as adjusting the axial rotation of the primary air flow.

5. A method according to claim 1 wherein the coarse particle portion of the pulverized fuel includes a pollution causing component and wherein the step of establishing the fluidized bed is further defined as establishing a fluidized bed containing a reactant for the pollution causing component.

6. A method according to claim 5 wherein the step of supplying the pulverized fuel is further defined as supplying the reactant along with the pulverized fuel above the fluidized bed and allowing the reactant to fall into the bed to react with the pollution causing component.

7. A method according to claim 1 wherein the coarse particle portion of the pulverized fuel includes a pollution causing component and wherein the step of establishing the fluidized bed is further defined as establishing a cooled fluidized bed for reducing production of pollutants by combustion in the fluidized bed.

8. A method according to claim 1 including the initial step of pulverizing the fuel by subjecting the fuel to impact.

9. A method according to claim 8 wherein the fuel undergoes single impact pulverization.

10. A method according to claim 9 wherein the step of pulverizing the fuel is further defined as accelerating the fuel by an air flow to a speed corresponding to the desired degree of pulverization and applying the accelerated fuel to an impact plate.

11. A method according to claim 8 wherein the step of pulverizing the fuel is further defined as varying the impact momentum of the fuel in the pulverizing step.

12. A method according to claim 1 further including the step of igniting the fluidized bed by radiant heat produced by the burning of the pulverized fuel above the fluidized bed.

13. A method according to claim 8 further defined as collecting at least a portion of a fine dust-like portion of the fuel produced by impact pulverization and using the collected portion as igniting fuel for the burning of the pulverized fuel.

14. A method according to claim 8 further defined as drying the fuel before impact pulverization.

15. A method according to claim 8 further defined as drying the fuel during impact pulverization.

16. A method according to claim 1 further defined as burning the fine particle portion of the fuel in an under stoichiometric state and operating the fluidized bed with an excess of combustion air.

17. A method according to claim 1 wherein the fluidized bed has a gas flow therethrough and wherein the method is further defined as blowing the primary air and pulverized fuel in the same direction as the flue gas flow of the fluidized bed.

18. A method according to claim 1 wherein the fluidized bed has a gas flow therethrough and wherein the method is further defined as blowing the primary air and pulverized fuel opposite to the flue gas flow of the fluidized bed.

19. A furnace for burning pulverized fuel, in particular pit coal, having, as a result of its pulverization, a fine particle portion and a coarse particle portion, said furnace comprising:
   a combustion chamber;
   a fluidized combustion bed in said chamber;
   air supply means for said fluidized bed fluidizing and permitting combustion in said bed;
   supply means for the pulverized fuel; and
   an annular pulverized fuel burner in said chamber, said pulverized fuel burner having a primary air-fuel supply tube connected to said pulverized fuel supply means and a concentric secondary air tube, said fuel burner being positioned in said chamber for discharging the pulverized fuel above said fluidized bed, said fuel burner separating the fine particle portion of the fuel from the coarse portion above said fluidized bed, burning the fine particle portion above said fluidized bed, and allowing the coarse particle portion to fall into the fluidized bed for combustion.

20. A furnace according to claim 19 wherein said pulverized fuel burner extends through said fluidized bed in a generally central position.

21. A furnace according to claim 19 wherein said dust pulverized burner is mounted in said combustion chamber above said fluidized bed.

22. A furnace according to claim 19 wherein said burner has a central secondary air tube and a concentric primary air-fuel supply tube having means for spirally rotating the air about the discharge axis.

23. A furnace according to claim 19 wherein the coarse particle portion of the pulverized fuel includes a pollution causing component and wherein said furnace includes means for supplying a reactant to the fluidized bed for the pollution causing component.

24. A furnace according to claim 23 wherein said reactant supply means includes said pulverized fuel burner, said reactant being discharged by said pulverized fuel burner above said fluidized bed and falling into said fluidized bed for reaction with the pollution causing component.

25. A furnace according to claim 19 wherein the coarse particle portion of the pulverized fuel includes a pollution causing component and wherein said furnace includes cooling means for said fluidized bed for reducing the production of pollutants by combustion in said fluidized bed.

26. A furnace according to claim 19 further including an after-burning chamber connected to the combustion chamber and means providing after-burning air to said after-burning chamber.

27. A furnace according to claim 19 wherein said fuel supply means includes impact pulverization means for said fuel.

28. A furnace according to claim 27 wherein said pulverized fuel burner has a primary air-fuel supply tube connected to an air supply and wherein said fuel supply means further includes pulverization means comprising: a housing having an upper end and lower end; an impact plate arranged in said housing; and impact nozzle in said housing connected to a fuel source and said air supply for pneumatically projecting fuel against said impact plate to pulverize same; said lower end of said housing being connected to said primary air supply tube of said pulverized fuel burner for supplying pulverized fuel to said burner, said upper end of said housing being connected with said primary air tube upstream of said lower end connection; and means for controlling the amount of air supplied to said impact nozzle and to said primary air tube.

29. A furnace according to claim 27 wherein said fuel supply means has filter means for separating off fine fuel dust and supplying same as ignition dust for said pulverized fuel burner.

30. A furnace according to claim 19 wherein said furnace comprises a plurality of selectively utilizable combustion elements, each comprising a fluidized bed and a pulverized fuel burner.

* * * * *

UNITED STATES PATENT AND TRADEMARK OFFICE

CERTIFICATE OF CORRECTION

PATENT NO. : 4,475,472

DATED : October 9, 1984

INVENTOR(S) : FRITZ ADRIAN ET AL

It is certified that error appears in the above-identified patent and that said Letters Patent is hereby corrected as shown below:

On the Cover Page, at "[30]", cancel "3130802" and insert --- 3130602.0 ---.

Signed and Sealed this

*Fourth* Day of *June 1985*

[SEAL]

*Attest:*

DONALD J. QUIGG

*Attesting Officer* *Acting Commissioner of Patents and Trademarks*